US008800063B2

(12) United States Patent
Cohen

(10) Patent No.: US 8,800,063 B2
(45) Date of Patent: Aug. 12, 2014

(54) SOCKS, AND SYSTEM AND METHOD FOR MANUFACTURING SOCKS

(75) Inventor: Avi Cohen, Kfar Vradim (IL)

(73) Assignee: Delta Galil Industries Ltd., Karmiel (IL)

( * ) Notice: Subject to any disclaimer, the term of this patent is extended or adjusted under 35 U.S.C. 154(b) by 0 days.

(21) Appl. No.: 13/820,511

(22) PCT Filed: Sep. 5, 2011

(86) PCT No.: PCT/IB2011/053876

§ 371 (c)(1), (2), (4) Date: Mar. 3, 2013

(87) PCT Pub. No.: WO2012/032457

PCT Pub. Date: Mar. 15, 2012

(65) Prior Publication Data

US 2013/0160191 A1 Jun. 27, 2013

Related U.S. Application Data

(60) Provisional application No. 61/380,370, filed on Sep. 7, 2010.

(51) Int. Cl.

| | |
|---|---|
| ***A43B 17/16*** | (2006.01) |
| ***D04B 1/26*** | (2006.01) |
| ***D04B 1/10*** | (2006.01) |
| ***A43B 17/10*** | (2006.01) |
| ***D04B 9/56*** | (2006.01) |
| ***A41B 11/02*** | (2006.01) |

(52) U.S. Cl.

CPC ..... *A43B 17/102* (2013.01); *D04B 1/26* (2013.01); *D04B 1/108* (2013.01); *D04B 9/56* (2013.01); *A41B 11/02* (2013.01); *A41B 2400/20* (2013.01)

USPC ..... 2/239

(58) Field of Classification Search

USPC ..... 2/239, 240, 241, 242, 409; 66/178 R, 66/182, 185, 196, 198, 184, 186

See application file for complete search history.

(56) References Cited

U.S. PATENT DOCUMENTS

| | | | | |
|---|---|---|---|---|
| 2,144,563 | A | 1/1939 | Davis | |
| 2,370,450 | A * | 2/1945 | Clarke | 66/185 |
| 2,663,175 | A | 12/1953 | Pons | |
| 4,341,097 | A | 7/1982 | Cassidy et al. | |
| 5,708,985 | A * | 1/1998 | Ogden | 2/239 |
| 6,292,951 | B1 | 9/2001 | Kalde | |
| 7,434,423 | B1 * | 10/2008 | Reid et al. | 66/178 A |
| 7,437,896 | B2 | 10/2008 | Hirao et al. | |
| 8,468,856 | B2 * | 6/2013 | Fukui | 66/178 R |
| 2006/0130217 | A1 | 6/2006 | Lambertz | |

OTHER PUBLICATIONS

International Search Report for corresponding PCT application PCT/IB2011/053876 mailed on Jul. 11, 2012.

* cited by examiner

*Primary Examiner* — Tejash Patel
(74) *Attorney, Agent, or Firm* — Eitan, Mehulal & Sadot

(57) ABSTRACT

The present invention includes socks, as well as a method and a system for manufacturing socks. For example, a sock includes a first area and a second area, wherein the first area includes increased knitting relative to the second area. For example, a method intended for utilization in conjunction with a knitting machine comprising one or more needles, includes selectively controlling operation of said one or more needles by selectively modifying operation of at least one of said one or more needles.

19 Claims, 6 Drawing Sheets

SOCKS, AND SYSTEM AND METHOD FOR MANUFACTURING SOCKS

PRIOR APPLICATION DATA

This application is a national phase of PCT International Application Number PCT/IB2011/053876, filed on Sep. 5, 2011, published as WO 2012/032457, which in turn claims priority and benefit from U.S. Provisional Patent Application No. 61/380,370, filed on Sep. 7, 2010, both of which are hereby incorporated by reference in their entirety.

FIELD

The present invention is related to the field of knitting.

BACKGROUND

A sock is a knitted garment used for enclosing and covering the human foot, and often also the lower part of the leg. Socks are usually aimed at isolating the foot from the outside temperature, absorbing moisture and sweat, and mitigating friction between the foot and the shoe.

Socks are often made of cotton, wool, polyester, nylon or other materials. Socks come in many colors and patterns, although the complexity and structure of the patterns is usually limited by the manufacturing techniques in use today.

SUMMARY

The present invention may include a sock or a pair of socks, as well as a method and a system for producing socks.

For example, a sock may include a first area and a second area, wherein the first area may include increased knitting relative to the second area. For example, a first point in the first area may include a first number of threads therein, and a second, neighboring, point in the first area may include a second, greater, number of threads therein. For example, the first area may include an increased-knitting strengthened area. For example, the second area may include a reduced-knitting ventilated area. For example, the first area (or the second area) may include a toe area or a heel area, and may be patterned or may have a knitted pattern. Optionally, the sock may have a patterned heel area.

For example, a knitting system may include: a knitting machine comprising one or more needles; and a control unit to selectively control operation of said one or more needles, the control unit including a knitting modifier module to selectively modify operation of at least one of said one or more needles. The control unit may include an increased knitting module to instruct the one or more needles to selectively knit an increased number of threads at one or more points. The control unit may include a reduced knitting module to instruct the one or more needles to selectively knit a reduced number of threads at one or more points. The reduced knitting module may instruct the one or more needles to selectively skip knitting at one or more points. The knitting machine may include a dial member to cut one or more threads; and the knitting system may include a dial displacement member to spatially displace the dial member during a time period in which the knitting modifier module modifies the operation of at least one of said one or more needles. The knitting system may be adapted to knit a sock having a first area and a second area, wherein the first area includes increased knitting relative to the second area. The knitting system may include a control interface to receive user input including one or more commands to the control unit. The knitting system may be adapted to produce a sock having a patterned heel area.

For example, a method intended for utilization in conjunction with a knitting machine comprising one or more needles, may include: selectively controlling operation of said one or more needles by selectively modifying operation of at least one of said one or more needles. The method may include instructing the one or more needles to selectively knit an increased number of threads at one or more points. The method may include instructing the one or more needles to selectively knit a reduced number of threads at one or more points. The method may include instructing the one or more needles to selectively skip knitting at one or more points. The knitting machine may include a dial member to cut one or more threads, and the method may include spatially displacing the dial member during modification of the operation of at least one of said one or more needles. The method may include instructing the knitting machine to automatically knit a sock having a first area and a second area, wherein the first area comprises increased knitting relative to the second area. The method may include receiving, through a control interface, user input indicating one or more commands to the knitting machine. The method may include, for example, producing a sock having a patterned heel area.

The present invention may provide other and/or additional benefits and/or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

At an overview, the present invention may include socks in which one or more particular areas (e.g., a toe area, a heel area or the like) are ventilated and/or strengthened and/or patterned. The present invention may further include a method and system for manufacturing such sock, for example, by selective operation of needle(s) in a knitting machine.

The present invention may include various embodiments or implementations, for example, a sock having a patterned heel area, a sock having a patterned toe area, a sock having a strengthened heel area, a sock having a strengthened toe area, a sock having a ventilated heel area, a sock having a ventilated toe area, a sock having a combination of two or more such features, or the like.

Figure 5:
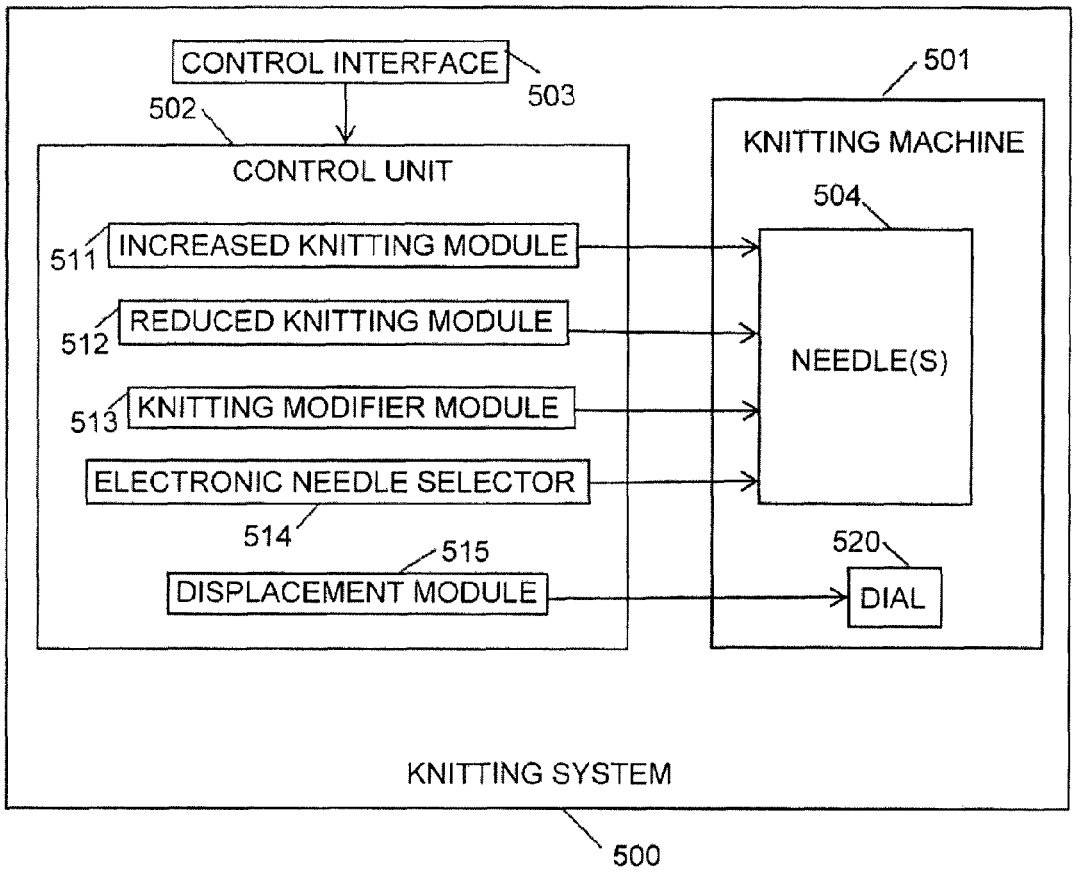
FIG. 5 is a schematic block diagram illustration of a knitting system, in accordance with the present invention.

Reference is made to FIG. 5, which is a schematic block diagram illustration of a knitting system 500 in accordance with the present invention. Knitting system 500 may include, for example, a knitting machine 501, a control unit 502, and a control interface 503.

Knitting machine 501 may include one or more needles 504, which may be selectively operated by control unit 502. A user may utilize control interface 503 to provide commands to control unit 502, for example, by instructing control unit to create a ventilated region, to create a strengthened region, to create a patterned region, or the like. Control unit 502 may be responsive to such commands, and may automatically operate the one or more needles 504 in accordance with such commands. Optionally, the commands may be entered by the user in a particular format or as a knitting program. Needles 504 may include multiple needles such that each needle may be selectively operated and/or controlled; such that each needle may have different knitting properties across different rows; and/or such that a first needle may have different knitting properties relative to a second, neighboring, needle. Needles 504 may be arranged in a circle, in row(s), or in any other suitable structure.

System 500 may optionally include other and/or additional units or components to facilitate the knitting method of the present invention. For example, system 500 may optionally include an increased knitting module 511, a reduced knitting module 512, a knitting modifier module 513, an electronic needle selector module 514, a dial member 520, and a dial member displacement module 515.

Increased knitting module 511 may cause needle(s) 504 to perform excessive knitting at a particular point or location. Reduced knitting module 512 may cause needle(s) 504 to perform reduced knitting (or, to skip knitting) at a particular point or location. Knitting modifier module 513 may cause needle(s) 504 to perform a modified knitting operation at a particular point or location, for example, utilizing a different thread. Modules 511-513 may be implemented as hardware components, and/or as software modules which may be part of control unit 502.

System 500 may utilize a knitting process which uses spiral or cylindrical knitting, in order to form a sock, row by row. In one or more areas intended to be formed as featured areas, further or different knitting operations may be performed, for example, reciprocate movement of needle(s) 504, in order to produce a "pocket" at the relevant area. For example, forward and backward movement of knitting machine 501 and/or needle(s) 504 may be used. Optionally, system 500 may utilize at first a smaller number of needles 504 and then a larger number of needles 504. Electronic needle selector module 514 may select needles 504 for knitting and/or for non-knitting (e.g., skipping) at particular points or regions. For example, prior to the forward movement, and/or prior to the backward movement, electronic needle selector module 514 may select which needles 504 may be activated or deactivated.

In a conventional knitting system, electronic selection of needles may be performed only before commencing the knitting of the heel area or the toe area, or only after terminating the knitting of the heel area or toe area. Furthermore, in a conventional knitting system, during the knitting of the heel area or toe area, the conventional knitting system may not perform electronic selection of needles, but rather may perform only mechanical knitting operations of moving needle(s) upwards and/or downwards. In contrast, a knitting system in accordance with the present invention may perform electronic selection of needle(s) 504 during the knitting of the heel area and/or the toe area, and not only before or after the knitting of the heel area or the toe area.

In accordance with the present invention, dial member 520 may be used to cut threads during the knitting of the heel area and/or toe area. Optionally, dial member 520 may be temporarily disabled, or may be temporarily removed or displaced spatially from the needles area, while the heel area or toe area are being knitted, in order to allow increased flexibility in modifying the properties of the operation of various needle(s) 504, and/or in order to allow electronic selection of needles 504 during the knitting of the heel or toe areas or other featured areas. Such removal or disabling of dial member 520 may be performed automatically, for example, by dial member displacement module 515, which may utilize one or more pistons or robotic arms or other suitable components, which may be connected to control unit 502 in order to automatically and timely perform such removal or displacement or disabling of dial member 520. The temporary removal or displacement of dial member 520, during the knitting of the heel or toe area or other featured area, may thus avoid or prevent cutting of threads by the dial member 520 during the knitting of such heel or toe areas or other featured area and may allow threads to remain hanging (e.g., from the knitting machine) during the process of knitting the heel or toe areas or other featured area. Only upon or towards the completion of the knitting of the heel or toe area or other featured area, may dial member displacement module 515 lower dial member 520 back to its original position, in proximity to the knitting needles 504. Dial member 520 may then cut the threads. Other suitable operations may be used.

Figure 1:
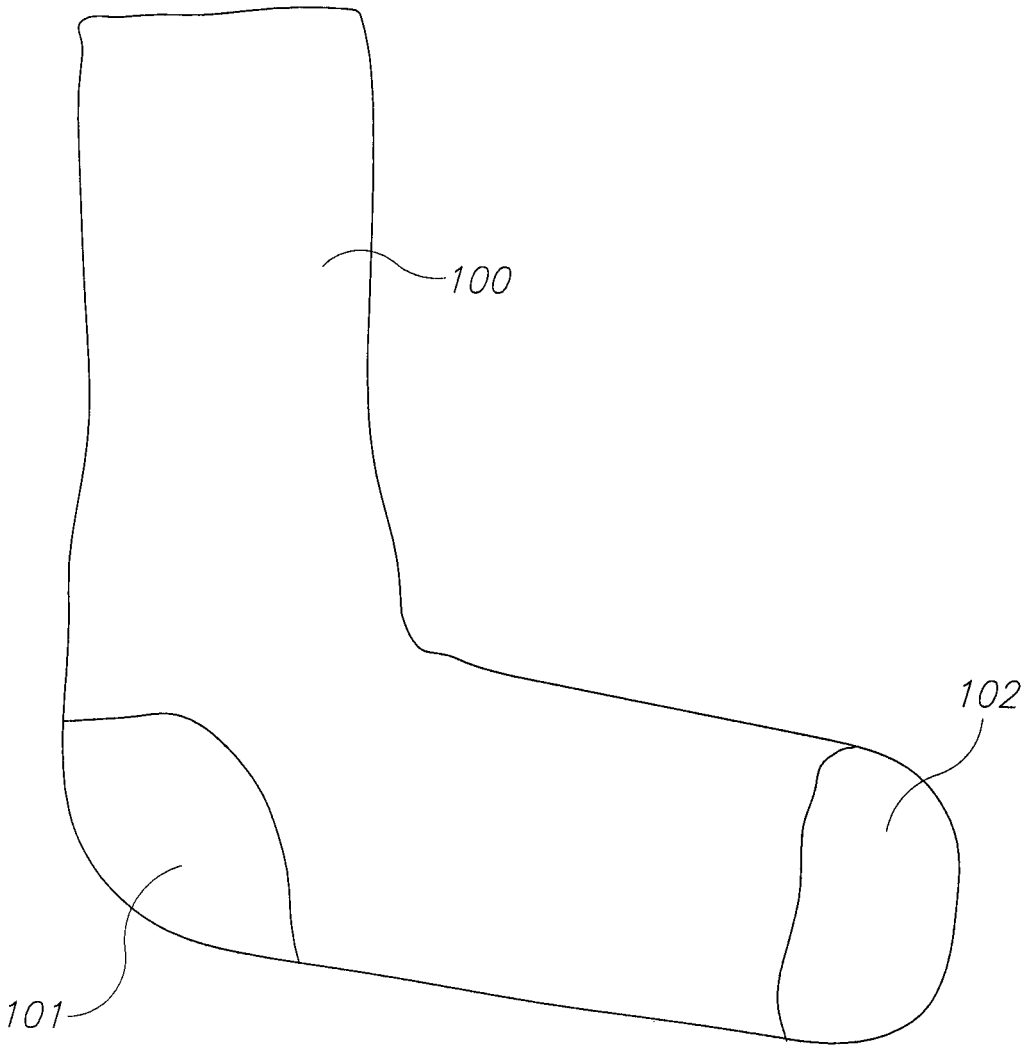
FIG. 1 is a schematic illustration of a sock, in accordance with the present invention.

Reference is made to FIG. 1, which is a schematic illustration of a sock 100 in accordance with the present invention. Sock 100 may include, for example, a heel area 101, a toe area 102, and/or other areas or regions.

In accordance with the present invention, heel area 101 and/or toe area 102 (and/or other area(s) in sock 100) may be ventilated or may have increased ventilation. Additionally or alternatively, heel area 101 and/or toe area 102 (and/or other area(s) in sock 100) may be strengthened or may have increased strength. Additionally or alternatively, heel area 101 and/or toe area 102 (and/or other area(s) in sock 100) may be patterned, for example, in accordance with a particular visible and knitted pattern, logo, and/or branding component. Optionally, one or more areas in sock 100, for example, heel area 101 and/or toe area 102, may have a combination of features, e.g., increased ventilation, increased strength, and/or a patterned component. Areas or regions of sock 100, which may have increased ventilation and/or increased strength and/or a patterned component, may be referred to herein as "featured areas" or "featured regions".

In accordance with the present invention, featured regions in sock 100 may be formed by additional or increased knitting or sawing of particular points or regions, in a selective process which utilizes needle-by-needle operations or point-by-point operations. Additionally or alternatively, featured regions in sock 100 may be formed by reduced or skipped knitting or sawing of particular points or regions, in a selective process which utilizes needle-by-needle operations or point-by-point operations.

Lines or rows of cotton may be knitted, back and forth. In accordance with the present invention, one time per K lines or rows (where K is a positive integer), an additional knitting operation may be performed, or an additional amount of cotton may be added by knitting. Additionally or alternatively, one time per L lines or rows (where L is a positive integer), a knitting or cotton-adding operation may be skipped or prevented or avoided.

Figure 2A:
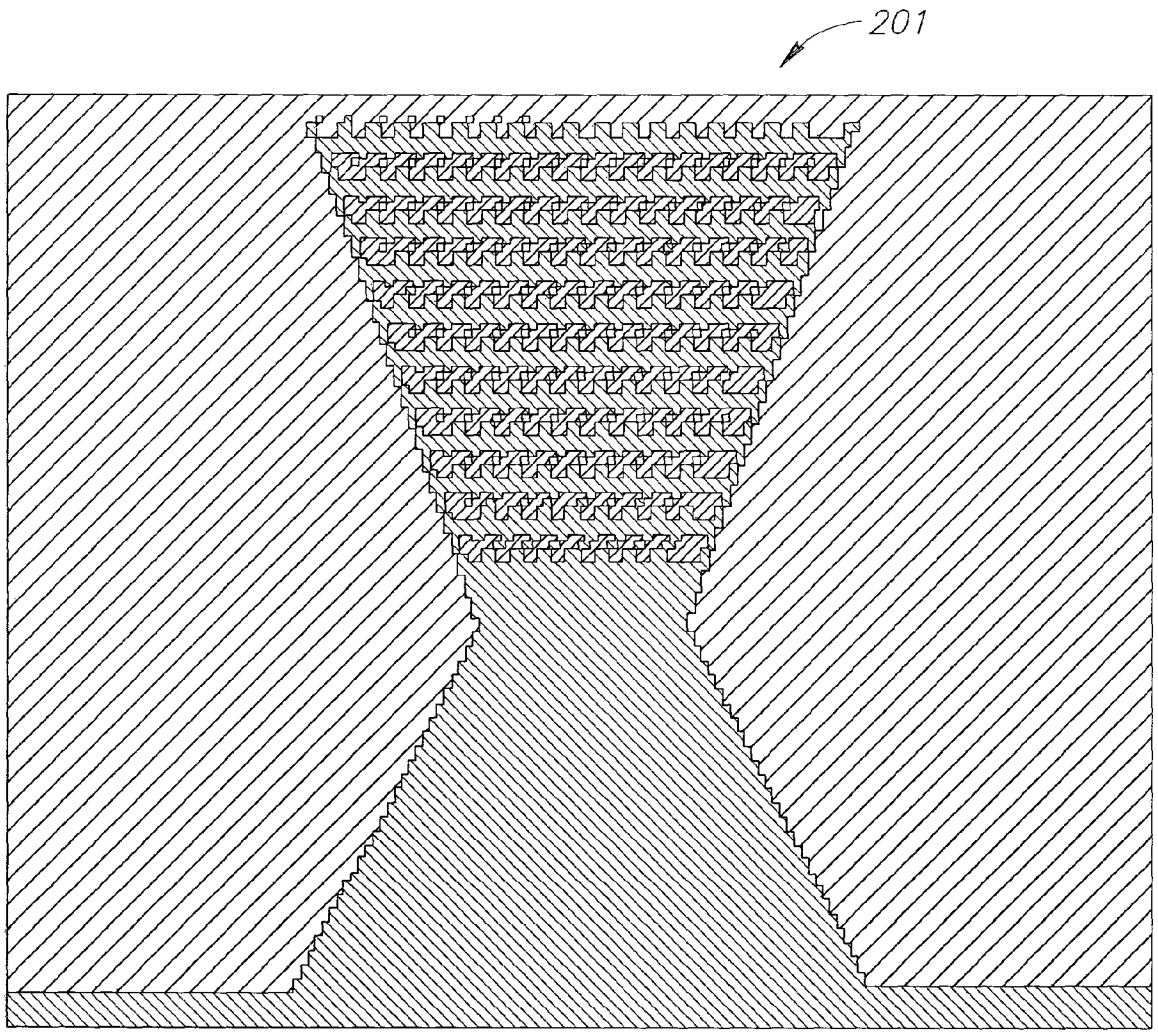
FIGS. 2A and 2B are schematic illustrations of knitting patterns, in accordance with the present invention.
Figure 2B:
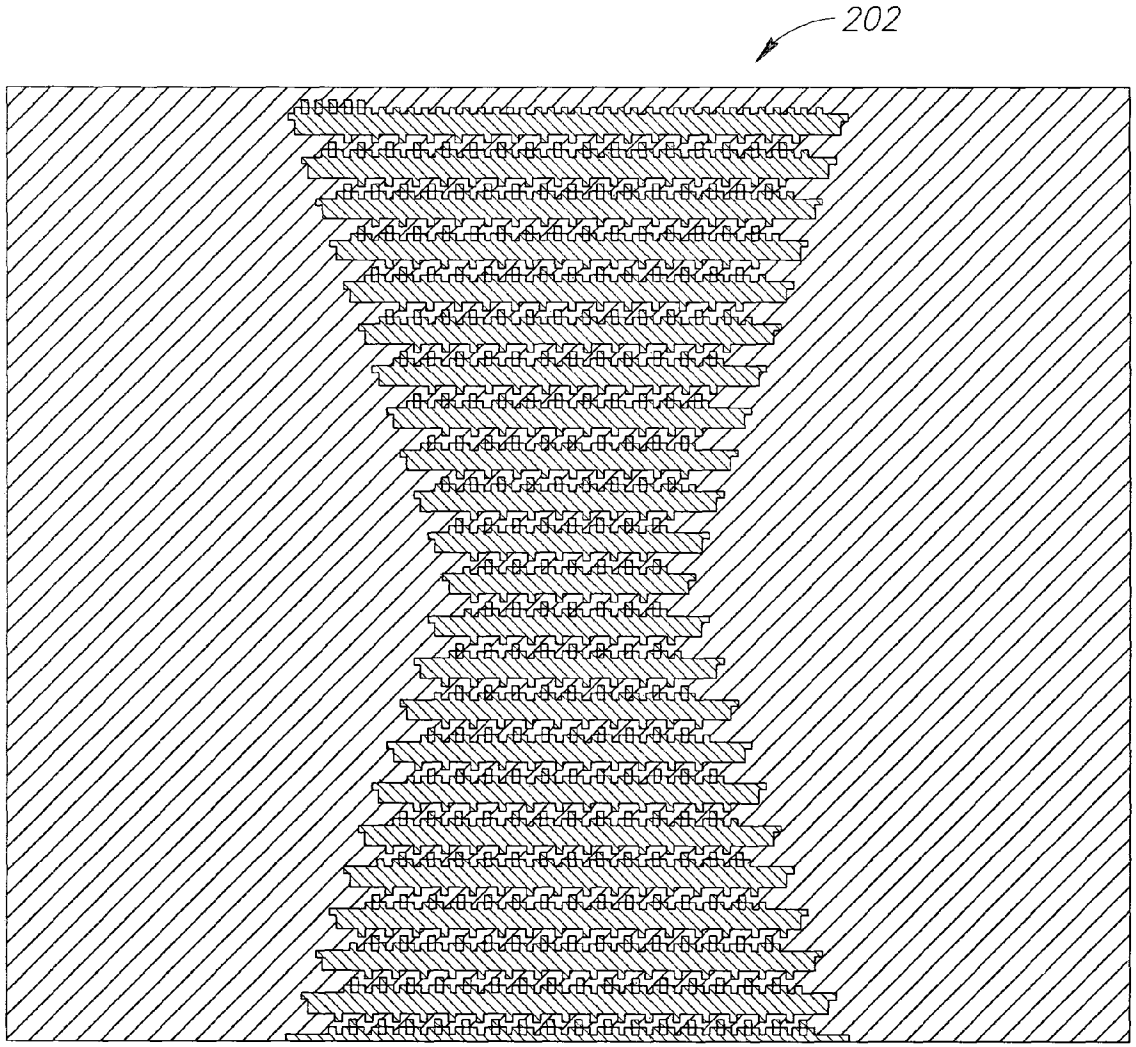

Reference is made to FIGS. 2A and 2B, which are schematic illustrations of knitting patterns 201 and 202, respectively, in accordance with the present invention. Knitting patterns 201 and 202 may be utilized, for example, in a system or method for manufacturing sock 100 of FIG. 1.

Knitting patterns 201 and 202 may demonstrate knitting of a region of sock 100 corresponding to movement of a knitting machine and may further demonstrate selective operation of needles in knitting of sock 100 which may be knitted with two different threads or strings at a tip of a knitting machine. The present invention may be utilized for knitting one thread or one string; or two threads or two strings; or any other suitable number of threads or strings. The present invention may utilize a knitting machine having multiple needles, which may be arranged in a circle or in one or more rows or in other suitable arrangements, and each needle (or each needle of a subset of all the needles) may be selectively controlled, modified, operated, activated and/or deactivated.

In knitting patterns 201 and 202, each horizontal line may correspond to a row of knitting in sock 100; and each square may represent a needle in such row. For example, a first row may indicate movement forward; the next row may indicate movement backward; the next row may indicate movement forward again, and so forth. In knitting patterns 201 and 202, a lighter-color square may represent a knitting needle at that point; and a darker-color square may represent a non-knitting needle at that point.

In accordance with the present invention, a featured region in sock 100 may be produced or knitted by selectively operating a needle of a knitting machine to knit only with a single thread (e.g., a background thread); whereas a region which is not a featured region ("non-featured region") may be knitted by selectively operating the needle of the knitting machine to knit with two or more threads (e.g., both the background thread and another, connecting, thread).

The present invention may allow production of socks having various patterns, which may be single-colored, dual-colored, triple-colored, or multi-colored. The present invention may knit with various types of threads, having different sizes, widths, thickness values, compositions, colors, and/or other physical properties. The term "thread" as used herein may include a single thread, a string, a yarn, or other singular line of cotton or wool or other material suitable for knitting or purling or stitching. The present invention may utilize various knitting techniques, for example, towel or towel-like knitting techniques, smooth knitting, stitching, or the like.

Figure 3:
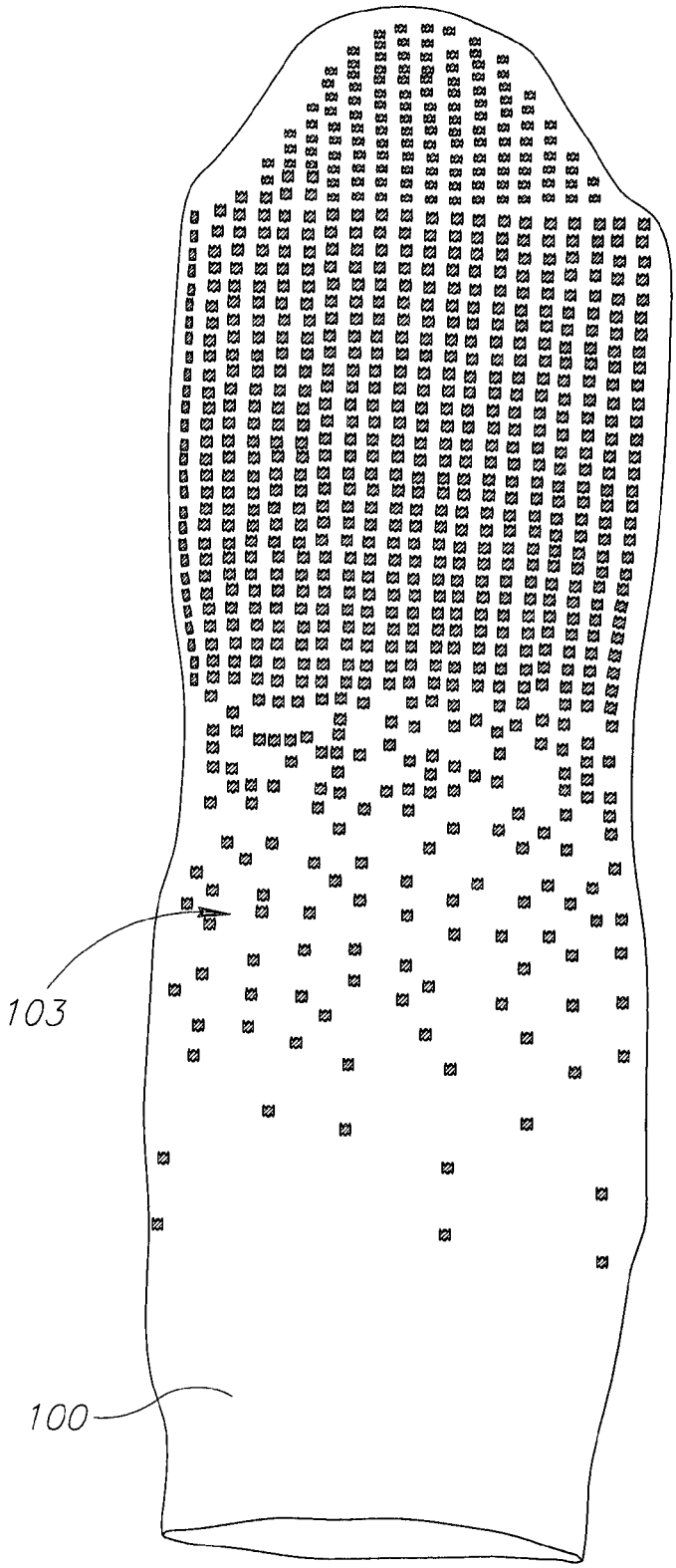
FIG. 3 is a schematic illustration of a sock having a demonstrative featured area, in accordance with the present invention.

Reference is made to FIG. 3, which is a schematic illustration of sock 100 having a demonstrative featured area 103, in accordance with the present invention. Darker squares in FIG. 3 may indicate, for example, points or locations in which reduced knitting or skipped knitting is selectively performed, to achieve ventilation of a region. Alternatively, darker squares may indicate points or locations in which double-knitting is selectively performed, to achieve strengthening of a region.

The following table, denoted Table 1, demonstrates a possible knitting arrangement in accordance with the present invention:

TABLE 1

| | | | | | |
|---|---|---|---|---|---|
| 1 | 2 | 1 | 2 | 1 | 2 |
| 2 | 1 | 2 | 1 | 2 | 1 |

In Table 1, each row may correspond to a row in sock 100 and each cell may correspond to a location of a needle along such a row. A cell having a value of "1" may indicate that a single thread may be knitted at that location; whereas a cell having a value of "2" may indicate that two threads may be knitted at that location, or that otherwise repetitive knitting or excessive knitting may be performed at that location. As a result, cells having a value of "1" may be ventilating more than cells having a value of "2". Additionally or alternatively, cells having a value of "2" may have increased strength relative to cells having a value of "1". Other suitable values may be used.

The pattern shown in Table 1 is only demonstrative, and other suitable knitting patterns may be used; optionally, other cell values may be used (e.g., a value of "3" to indicate that three threads may be knitted at a location, or the like). In accordance with the present invention, each needle may selectively change its knitting properties from a first row to a subsequent (consecutive or non-consecutive) row. For example, a particular needle may knit with one thread in a first row (or in odd-number rows of a particular area or region), and may knit with two threads in a second row (or in even-number rows of that particular area or region). Other suitable values may be used.

The present invention may optionally utilize, for example, high yarn count, fine yarn count, or other suitable types of threads or materials or yarn count.

Figure 4:
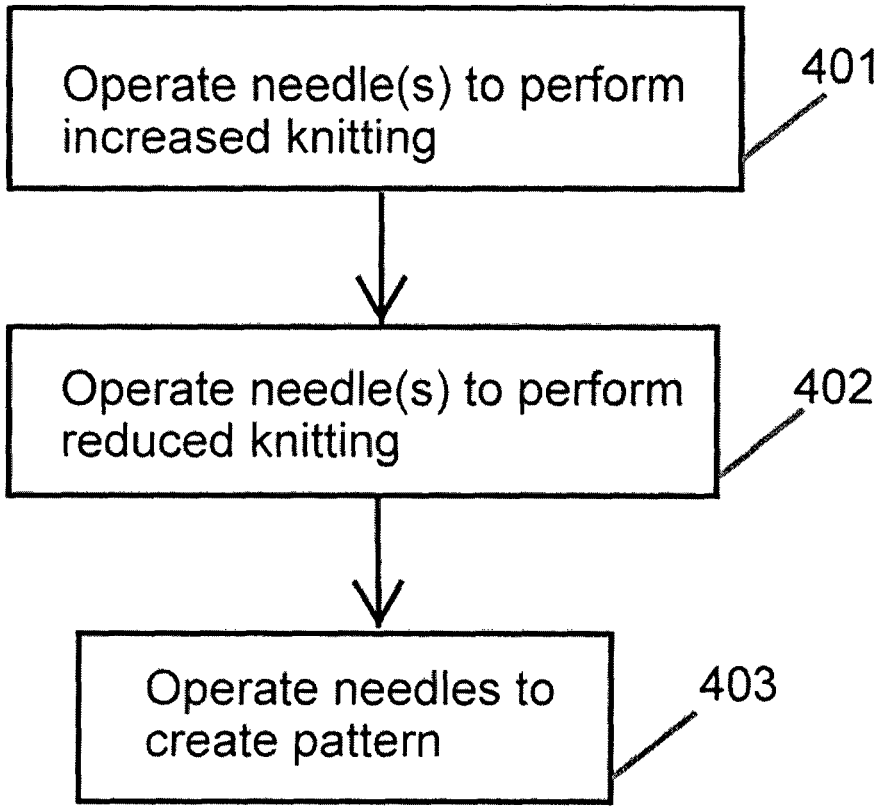
FIG. 4 is a schematic flow-chart of a method of producing a sock, in accordance with the present invention.

Reference is made to FIG. 4, which is a schematic flowchart of a method of producing a sock, in accordance with the present invention.

The method may optionally include, for example, selectively operating one or more needles of a knitting machine to perform increased knitting in an area of interest, e.g., to create a strengthened area (block 401). The method may terminate at this step; or may continue to other steps described herein; or may perform other suitable operations.

The method may optionally include, for example, selectively operating one or more needles of a knitting machine to perform reduced knitting in an area of interest, e.g., to create a ventilated area (block 402). The method may terminate at this step; or may continue to other steps described herein; or may perform other suitable operations.

The method may optionally include, for example, selectively operating one or more needles of a knitting machine to create a pattern in an area of interest, e.g., to create a patterned area (block 403). The method may terminate at this step; or may continue to other steps described herein; or may perform other suitable operations.

Other suitable operations may be used in accordance with the present invention. Optionally, only one or two of the operations of blocks 401-403 may be performed, or all three operations of blocks 401-403 may be performed. Operations may be performed in other suitable order(s).

Optionally, the method may include other and/or additional operations, which may include, for example: selectively and/or automatically controlling operation of one or more needles by selectively modifying operation of at least one of the one or more needles; instructing the one or more needles to selectively knit an increased number of threads at one or more points; instructing the one or more needles to selectively knit a reduced number of threads at one or more points; instructing the one or more needles to selectively skip knitting at one or more points; spatially displacing a dial member during modification of the operation of at least one of the one or more needles; instructing the knitting machine to automatically knit a sock having a first area and a second area, wherein the first area includes increased knitting relative to the second area; receiving, through a control interface, user input indicating one or more commands to the knitting machine; and/or other suitable operations or sets of operations which may be performed in particular implementations.

The present invention may include a sock, or a pair of socks, intended to be worn by a man, a woman, a child, or other persons. Optionally, aspects of the present invention may be applied to other garments or clothes (e.g., leggings, calf-warmers, tights, or the like), as well as to methods and systems for manufacturing such other garments or clothes.

Optionally, the present invention may be utilized to manufacture socks in which the toe area and/or the heel area are strengthened and/or ventilated and/or features, and/or may have a hem or a double-hem or welt or double-welt, or may be connected to other areas of the sock via a single hem or a double-hem or single welt or double-welt.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the following claims are intended to cover all such modifications, substitutions, changes, and equivalents.

What is claimed is:

1. A sock comprising a heel area and a foot area, wherein the heel area comprises a non-linear knitted patterned component having a selective point-by-point increased knitting relative to the foot area;

wherein at least one point in the heel area, comprises at least double-knitting at said one point, and is surrounded exclusively by points having only single-knitting.

2. The sock of claim 1, wherein a first point in the heel area comprises a first number of threads knitted therein, and wherein a second, neighboring, point in the heel area comprises a second, greater, number of threads knitted therein.

3. The sock of claim 1, wherein the heel area comprises an increased-knitting strengthened area.

4. The sock of claim 1, wherein the heel area comprises a reduced-knitting ventilated area.

5. A knitting system comprising:

a knitting machine comprising one or more needles; and a control unit to selectively control operation of said one or more needles, the control unit comprising a knitting modifier module to selectively modify operation of at least one of said one or more needles causing the knitting machine to knit a sock comprising a heel area and a foot area, wherein the heel area comprises a non-linear knitted patterned component having a selective point-by-point increased knitting relative to the foot area; wherein at least one point in the heel area, comprises at least double-knitting at said one point, and is surrounded exclusively by points having only single-knitting.

6. The knitting system of claim 5, wherein the control unit comprises:

an increased knitting module to instruct the one or more needles to selectively knit an increased number of threads at one or more points.

7. The knitting system of claim 5, wherein the control unit comprises:

a reduced knitting module to instruct the one or more needles to selectively knit a reduced number of threads at one or more points.

8. The knitting system of claim 7, wherein the reduced knitting module is to instruct the one or more needles to selectively skip knitting at one or more points.

9. The knitting system of claim 5, wherein the knitting machine comprises a dial member to cut one or more threads, and wherein the knitting system comprises a dial displacement member to spatially displace the dial member during a time period in which the knitting modifier module modifies the operation of at least one of said one or more needles.

10. The knitting system of claim 5, comprising a control interface to receive user input including one or more commands to the control unit.

11. A method intended for utilization in conjunction with a knitting machine comprising one or more needles, the method comprising:

selectively controlling operation of said one or more needles by selectively modifying operation of at least one of said one or more needles causing the knitting machine to knit a sock comprising a heel area and a foot area, wherein the heel area comprises a non-linear knitted patterned component having a selective point-by-point increased knitting relative to the foot area; wherein at least one point in the heel area, comprises at least double-knitting at said one point, and is surrounded exclusively points having only single-knitting.

12. The method of claim 11, comprising:

instructing the one or more needles to selectively knit an increased number of threads at one or more points.

13. The method of claim 11, comprising:

instructing the one or more needles to selectively knit a reduced number of threads at one or more points.

14. The method of claim 12, comprising:

instructing the one or more needles to selectively skip knitting at one or more points.

15. The method of claim 11, wherein the knitting machine comprises a dial member to cut one or more threads, and wherein the method comprises:

spatially displacing the dial member during modification of the operation of at least one of said one or more needles.

16. The method of claim 11, comprising:

receiving, through a control interface, user input indicating one or more commands to the knitting machine.

17. The sock of claim 1, wherein the non-linear knitted patterned component of selective point-by-point increased knitting is a knitted non-linear scattered pattern in said heel area.

18. The sock of claim 1, wherein the non-linear knitted patterned component of selective point-by-point increased knitting is a knitted branding component in said heel area.

19. The sock of claim 1, wherein the non-linear knitted patterned component of selective point-by-point increased knitting is a knitted logo in said heel area.

* * * * *